US010737833B2

(12) United States Patent
Coq et al.

(10) Patent No.: US 10,737,833 B2
(45) **Date of Patent: *Aug. 11, 2020**

(54) PALLET GAP FILLER

(71) Applicant: International Business Machines Corporation, Armonk, NY (US)

(72) Inventors: Marc H. Coq, Hopewell Junction, NY (US); William J. Green, Cary, NC (US); Michael D. O'Connell, Rochester, MN (US); Sharon T. Spaulding, Highland, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/432,241

(22) Filed: Jun. 5, 2019

(65) Prior Publication Data

US 2019/0283932 A1 Sep. 19, 2019

Related U.S. Application Data

(63) Continuation of application No. 15/802,683, filed on Nov. 3, 2017, now Pat. No. 10,392,160.

(51) Int. Cl.
*B65D 19/38* (2006.01)
*B66F 9/12* (2006.01)

(52) U.S. Cl.
CPC ..... *B65D 19/38* (2013.01); *B66F 9/12* (2013.01); *B65D 2519/00273* (2013.01); *B65D 2519/00572* (2013.01); *B65D 2519/00776* (2013.01)

(58) Field of Classification Search
CPC .... B25J 9/142; B65D 19/38; B65D 25/00796; B65D 25/00776; B66F 9/18; B66F 9/185; B66F 9/12; B66F 9/125
See application file for complete search history.

(56) References Cited

U.S. PATENT DOCUMENTS 5,941,179 A 8/1999 Herring
6,926,144 B1 8/2005 Schnaars, Jr. et al.
(Continued)

FOREIGN PATENT DOCUMENTS

CN 206244345 U 6/2017
JP 2003261297 A 9/2003
(Continued)

OTHER PUBLICATIONS

List of IBM Patents on Patent Applications Treated as Related; (Appendix P), Filed Jun. 5, 2019; 2 pages.

*Primary Examiner* — Kaitlin S Joerger
(74) *Attorney, Agent, or Firm* — Cantor Colburn LLP; Tihon Poltavets

(57) ABSTRACT

A pallet gap filler for a pallet and a lift is provided. The pallet gap filler includes filling and engaging elements. The filling element is insertable into a portion of a space defined between tines of the lift and one or more of top and bottom decks and blocks and/or stringers separating the top and bottom decks of the pallet. The filling element is configured to assume a first configuration during filling element insertion and a second configuration in which, following filling element insertion, the filling element fixes relative orientations of the pallet and the lift. The engaging element is actuatable with the filling element initially assuming the first configuration to cause the filling element to assume the second configuration.

16 Claims, 4 Drawing Sheets

(56) References Cited

U.S. PATENT DOCUMENTS

| | | | | |
|---|---|---|---|---|
| 9,260,125 | B2 * | 2/2016 | Ellington | B62B 3/06 |
| 9,403,547 | B2 * | 8/2016 | Ellington | B62B 3/06 |
| 9,908,761 | B2 * | 3/2018 | Apps | B66F 9/12 |
| 2014/0137774 | A1 * | 5/2014 | Randall | B65D 19/0095 108/50.11 |
| 2016/0325881 | A1 | 11/2016 | Embleton et al. | |
| 2016/0325973 | A1 * | 11/2016 | Ellington | B62B 3/06 |
| 2017/0106534 | A1 * | 4/2017 | Nakamoto | B25J 9/1075 |

FOREIGN PATENT DOCUMENTS

| | | | |
|---|---|---|---|
| JP | 2003267688 | A | 9/2003 |
| JP | 2004244144 | A | 9/2004 |
| KR | 1020120071038 | A | 7/2012 |

* cited by examiner

PALLET GAP FILLER

CROSS-REFERENCE TO RELATED APPLICATIONS

This application is a continuation application of U.S. application Ser. No. 15/802,683, titled "PALLET GAP FILLER", which was filed on Nov. 3, 2017. The entire contents of U.S. application Ser. No. 15/802,683 are incorporated herein by reference.

BACKGROUND

The disclosure relates generally to a pallet gap filler that can be employed to prevent tip-over incidents of heavy items in transit.

Rack systems are widely available and often very high in value. They can be provided as storage racks, mainframe racks, computer racks, security device racks, etc. When rack systems are loaded, the total value of each rack system and the load can be in the millions of dollars. Rack systems are typically tall, heavy and relatively unstable. They are often top-heavy and prone to tipping over especially during transport.

SUMMARY

According to one or more embodiments, a pallet gap filler for a pallet and a lift is provided. The pallet gap filler includes filling and engaging elements. The filling element is insertable into a portion of a space defined between tines of the lift and one or more of top and bottom decks and blocks and/or stringers separating the top and bottom decks of the pallet. The filling element is configured to assume a first configuration during filling element insertion and a second configuration in which, following filling element insertion, the filling element fixes relative orientations of the pallet and the lift. The engaging element is actuatable with the filling element initially assuming the first configuration to cause the filling element to assume the second configuration.

According to one or more embodiments, a method of operating a pallet gap filler for a pallet and a lift including tines insertable into the pallet is provided. The method includes controlling a filling element to assume a first configuration, inserting the filling element into the pallet with or following tine insertion and controlling the filling element to assume a second configuration in which the filling element fixes relative orientations of the pallet and the lift.

According to one or more embodiments, a lift assembly for a pallet including top and bottom decks and blocks and/or stringers separating the top and bottom decks is provided. The lift assembly includes tines insertable into a space between the top and bottom decks and the blocks and/or stringers and a lift. The lift is coupled to the tines and is operable to control the tines to maneuver the pallet following tine insertion. The tines are configured to assume a first configuration during tine insertion and a second configuration in which, following tine insertion, the tines fix an orientation of the pallet relative to the lift. The lift assembly further includes an engaging element actuatable with the tines initially assuming the first configuration to cause the tines to assume the second configuration.

According to one or more embodiments, a method of operating a lift assembly for a pallet that includes top and bottom decks and blocks and/or stringers separating the top and bottom decks. The method includes controlling tines, which are coupled to a lift and insertable into a space between the top and bottom decks and the blocks and/or stringers, to assume a first configuration. The method further includes inserting the tines into the space and controlling the tines to assume a second configuration in which the tines fix an orientation of the pallet relative to the lift.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

The diagrams depicted herein are illustrative. There can be many variations to the diagram or the operations described therein without departing from the spirit of the invention. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

In the accompanying figures and following detailed description of the disclosed embodiments, the various elements illustrated in the figures are provided with two or three digit reference numbers. With minor exceptions, the leftmost digit(s) of each reference number correspond to the figure in which its element is first illustrated.

DETAILED DESCRIPTION

Damage due to tip-over incidents of rack systems is a prevalent and common danger associated with shipping of rack system products. Rack systems are typically tall, heavy and top-heavy and are thus prone to tipping over and when they do the damage and equipment losses can be catastrophic and may be valued in the millions of dollars. Indeed, damage from tip-overs of rack systems can result in total losses of the high-value hardware, loss of customer satisfaction and delays in schedules.

Figure 1:
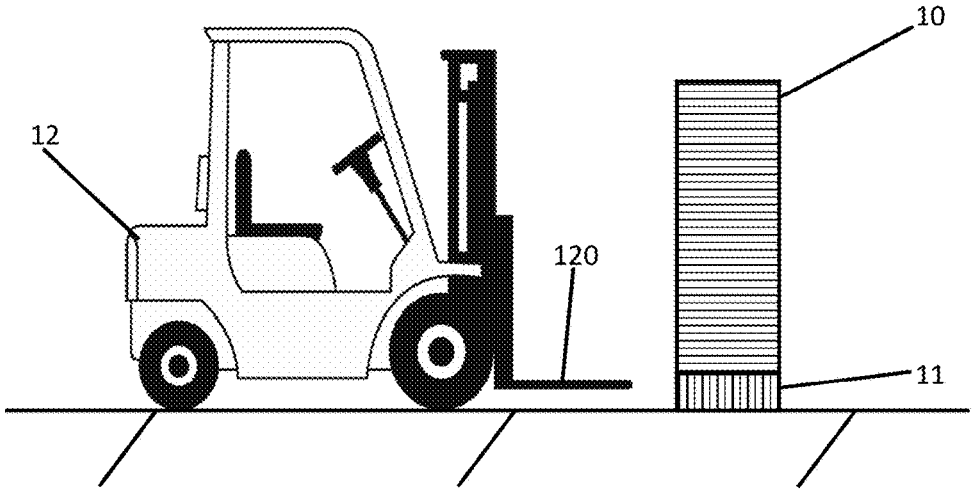
FIG. 1 is an illustration of a forklift with tines approaching a rack system on a pallet.
Figure 2:
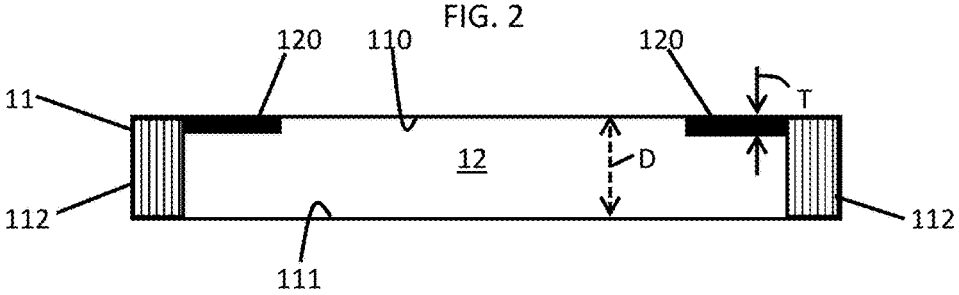
FIG. 2 is a schematic illustration of a pallet.

With reference to FIGS. 1 and 2, rack systems, such as exemplary rack system 10, are shipped in packages that include a pallet 11. Pallets facilitate non-manual handling by, for example, a forklift 12. The pallet 11 includes a top deck 110, a bottom deck 111 and blocks and/or stringers 112. The top and bottom decks 110 and 111 are each affixed to the blocks and/or stringers 112 by fasteners such that the blocks and/or stringers 112 support the top deck 110 above the bottom deck 111 at a distance D. The pallet 11 thus forms an interior space 13 between the top and bottom decks 110 and 111 and between the blocks and/or stringers 112. The forklift 12 can be a manned or unmanned vehicle with tines 120 that extend forwardly (or rearward). The blocks and/or stringers 112 are sized such that the distance D between the top deck 110 and the bottom deck 111 is sufficient to permit insertion of the tines 120 therein. That is, the distance D exceeds a thickness T of the tines 120. In some cases, the distance D substantially exceeds the thickness T of the tines 120.

A "block" pallet 11 normally allows for full access to its interior space 13 for the tines 120 of a fork lift 12 on all four sides. By contrast, the stringers of a "stringer" pallet 11 extend along two sides of the pallet 11 and thus prevent tine 120 access on those two sides. In some cases, however, the stringers may be formed to define notches in which the tines 120 can be inserted.

Although the following description is generally related to the case of the pallet 11 being a "block" pallet 11, it is to be understood that this has been done for purposes of clarity and brevity and that the various embodiments of the invention are applicable to both "block" pallets 11 and "stringer" pallets 11.

As shown in FIG. 1, the forklift 12 generally operates by initially approaching the rack system 10 and the pallet 11 with the tines 120 disposed relatively low to the ground. If the forklift 12 is approaching the front of the pallet 11 and the tines 120 are level with the interior space 13 (see FIG. 2), the tines 120 will eventually become inserted into the interior space 13. At this point, the forklift 12 can begin to raise the tines 120 such that they but with a lower surface of the top deck 110. Further raising of the tines 120 by the forklift will result in the lifting and maneuvering of the pallet 11 and the rack system 10 thereon.

Figure 3:
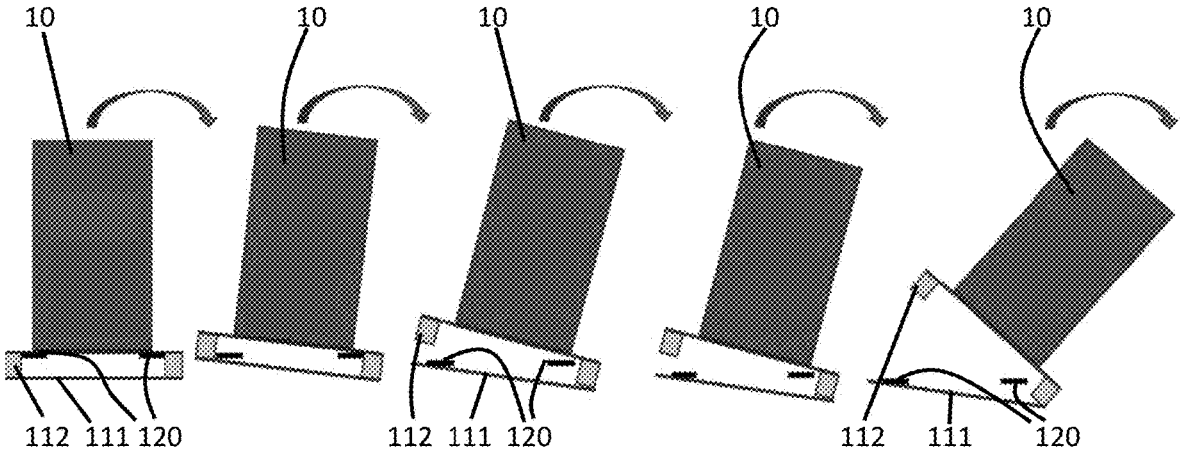
FIG. 3 is a schematic illustration of a tilting incident once the forklift of FIG. 1 begins maneuvering the pallet of FIG. 2.

With continued reference to FIGS. 1 and 2 and with additional reference to FIG. 3, since the distance D between the top and bottom decks 110 and 111 of the pallet 11 exceeds the thickness of the tines 120, there is a gap formed between the tines 120 and the bottom deck 111 during the lifting of the pallet 11 and the rack system 10. This gap can destabilize the pallet 11 and the rack system 10 especially during a turning maneuver of the forklift 12. That is, as shown in FIG. 3, if the pallet 11 and the rack system 10 begin to tilt during the lifting, their combined weights generate a moment arm that encourages greater tilting and an eventual impact between one of the tines 120 and the bottom deck 111. This impact can be strong enough to pull out the fasteners securing the bottom deck 111 to the proximal block and/or stringer 112 at which point the combined weight of the pallet 11 and the rack system 10 will continue to topple over.

In view of the above, embodiments disclosed herein can relate to a gap filler or a modified tine that can be triggered to expand and thus to brace against the bottom deck of a pallet. This "gap filling" prevents tines from losing contact with the top deck and in turn prevents a tipping of the pallet. The gap filler or modified tine can be controlled electrically, pneumatically, hydraulically or via gravity to achieve appropriate upward and downward movements during operation.

Figure 4:
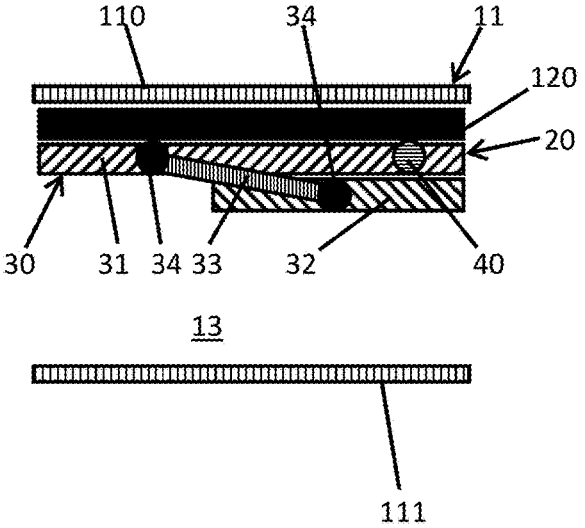
FIG. 4 is a side view of a pallet gap filler in a first configuration in accordance with embodiments.
Figure 5:
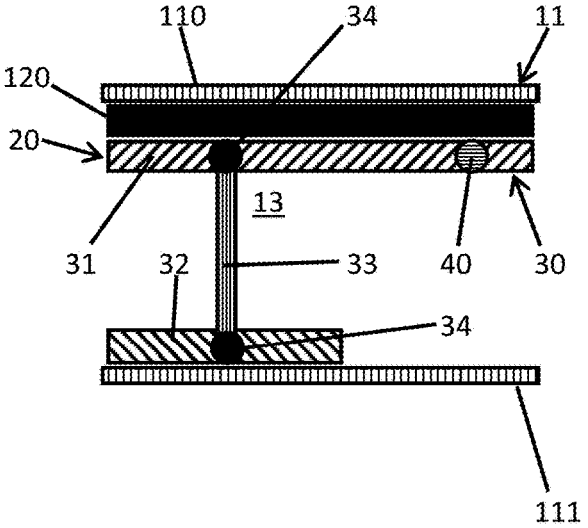
FIG. 5 is a side view of the pallet gap filler of FIG. 4 in a second configuration in accordance with embodiments.
Figure 6:
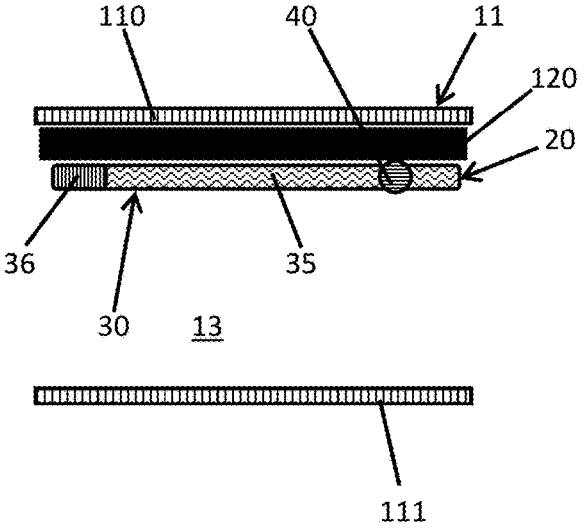
FIG. 6 is a side view of a pallet gap filler in a first configuration in accordance with embodiments.
Figure 7:
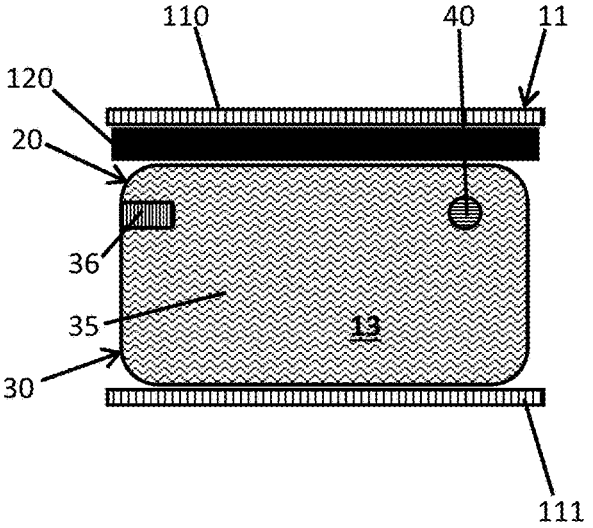
FIG. 7 is a side view of the pallet gap filler of FIG. 6 in a second configuration in accordance with embodiments.

Turning now to FIGS. 4 and 5 and to FIGS. 6 and 7, a pallet gap filler 20 for use with the rack system 10, the pallet 11 and the forklift 12 of FIGS. 1-3 is provided. The pallet gap filler 20 includes a filling element 30, which is separate from the tines 120, and an engaging element 40.

The filling element 30 is insertable into a portion of the interior space 13. This portion of the interior space 13 is defined between the (previously inserted) tines 120 and one or more of the top deck 110, the bottom deck 111 and the blocks and/or stringers 112. The filling element 30 is configured to assume a first configuration during filling element insertion into the portion of the interior space 13 and a second configuration. In the second configuration, the filling element 30 expands and partially or completely fills the portion of the interior space 13. In so doing, the filling element 30 effectively fixes relative orientations of the pallet 11 and the fork lift 12.

The engaging element 40 may be proximal to or remote from the filling element 30 and is actuatable automatically or by an operator. In the former case, the engaging element 40 may include or be provided as a sensor (e.g., an electromagnetic sensor, an optical sensor, a piezoelectric sensor, etc.) which senses the insertion of the filling element 30 in the portion of the interior space 13. In the latter case, the engaging element 40 may include or be provided as an actuatable button or switch that is proximate to or remote from the filling element 30. In either case, when the engaging element 40 is actuated with the filling element 30 initially assuming the first configuration, the engaging element 40 causes the filling element 30 to assume the second configuration.

In accordance with embodiments and, as shown in FIG. 4, the filling element 30 may include a first plate 31, a second plate 32, a pivot arm 33 and a driving element 34. The pivot arm 33 is pivotally coupled (by, e.g., hinges or pin connections) at opposite ends thereof to the first plate 31 and to second plate 32, respectively. The driving element 34 is operable by the engaging element 40 to securely drive a pivoting of the pivot arm 33 relative to the first and second plates 31 and 32. The driving element 34 may include or be provided as an electromagnetic, hydraulic or manual driving element and may be proximate to or remote from the pivot arm 33. In any case, the driving element 34 may be further configured to maintain the pivot arm 33 in the pivoted condition so that, when the filling element 30 assumes the second configuration and is loaded by the pallet 11 and the rack system 10 (see FIGS. 1 and 3), the filling element 30 can securely remain in the second configuration.

While the filling element 30 is insertable into the interior space 13 is various arrangements (e.g., with the filling element 30 between the tines 120 and the top deck 110, between the tines 120 and the bottom deck 111 or between the tines 120 and the block and/or stringer 112), FIG. 4 shows that the filling element 30 is inserted between the tines 120 and the bottom deck 111 for illustrative purposes only. Here, the filling element 30 can be inserted into the portion of the interior space 13 while assuming the first configuration such that the first plate 31 abuts against lower surfaces of the tines 120 and the pivot arm 33 is angled such that the second plate 32 is proximate to the first plate 31 and displaced from an upper surface of the bottom deck 111.

As shown in FIG. 5, once insertion of the filling element 30 is complete and the engaging element 40 is actuated, the driving element 34 causes the pivot arm 33 to securely pivot relative to the first and second plates 31 and 32. This secure pivoting drives the second plate 32 downwardly until the second plate 32 abuts with the upper surface of the bottom deck 111 and maintains the second plate 32 in that downwardly driven location. The filling element 30 thereby assumes the second configuration in which the filling element 30 effectively and securely fills the gap between the lower surfaces of the tines 120 and the upper surface of the bottom deck 111. The filling element 30 thus prevents a change in the relative orientations of the pallet 11 and the forklift 12 and secures the pallet 11 against tipping.

In accordance with embodiments and, as shown in FIG. 6, the filling element 30 may include an inflatable bladder 35 and an inflating element 36 which is operable by the engaging element 40 to inflate the inflatable bladder 35. The inflatable bladder 35 may be formed of compliant or elastomeric materials that are wear and puncture resistant so that the inflatable bladder 35, once inflated, can remain inflated. The inflating element 36 is operable by the engaging element 40 to securely inflate the inflatable bladder 35. The inflating element 36 may include or be provided as an electromagnetic, hydraulic or manual inflating element and may be proximate to or remote from the inflatable bladder 35. In any case, the inflating element 36 may be further configured to maintain the inflation level of the inflatable bladder 35 so that, when the filling element 30 assumes the second configuration and is loaded by the pallet 11 and the rack system 10 (see FIGS. 1 and 3), the filling element 30 can securely remain in the second configuration.

While the filling element 30 is insertable between the tines 120 and the top deck 110, between the tines 120 and the bottom deck 111 or between the tines 120 and the block and/or stringer 112, FIG. 6 shows that the filling element 30 is inserted between the tines 120 and the bottom deck 111 for illustrative purposes only. Here, the filling element 30 can be inserted into the portion of the interior space 13 while assuming the first configuration such that the inflatable bladder 35 extends through a portion of the pallet 11 in a un-inflated condition.

As shown in FIG. 7, once insertion of the filling element 30 is complete and the engaging element 40 is actuated, the inflating element 36 causes the inflatable bladder 35 to securely inflate such that the inflatable bladder 35 abuts with and pressurizes the tines 120 and the upper surface of the bottom deck 111. The filling element 30 thereby assumes the second configuration in which the filling element 30 effectively and securely fills the gap between the lower surfaces of the tines 120 and the upper surface of the bottom deck 111. The filling element 30 thus prevents a change in the relative orientations of the pallet 11 and the forklift 12 and secures the pallet 11 against tipping.

Figure 8:
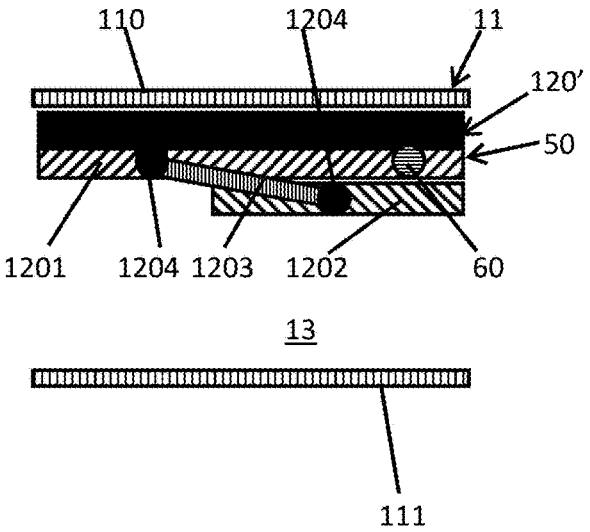
FIG. 8 is a side view of components of a lift assembly in a first configuration in accordance with embodiments.
Figure 9:
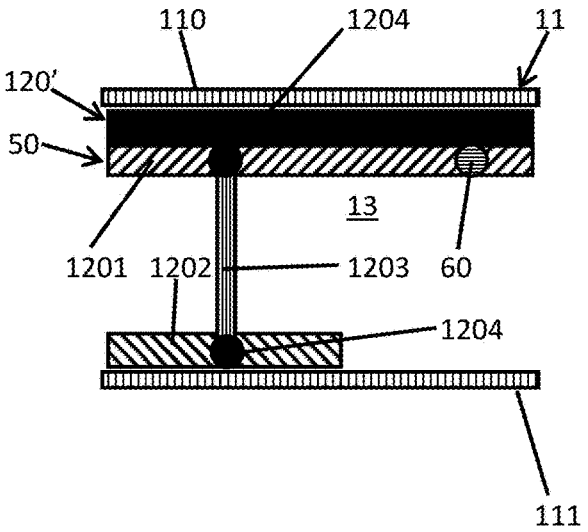
FIG. 9 is a side view of the components of the lift assembly of FIG. 8 in a second configuration in accordance with embodiments.
Figure 10:
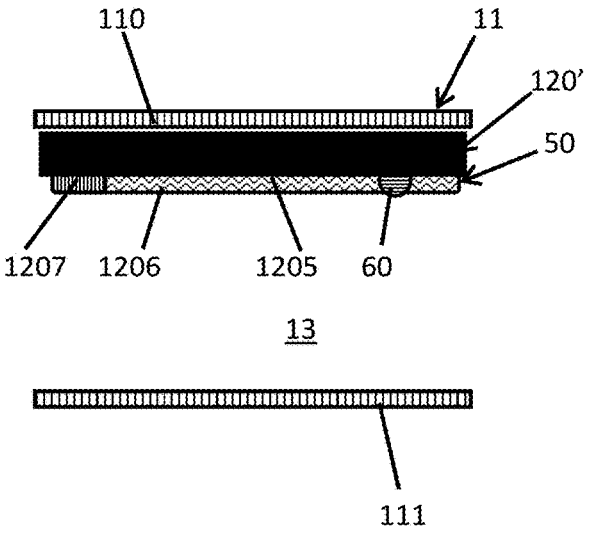
FIG. 10 is a side view of components of a lift assembly in a first configuration in accordance with embodiments.
Figure 11:
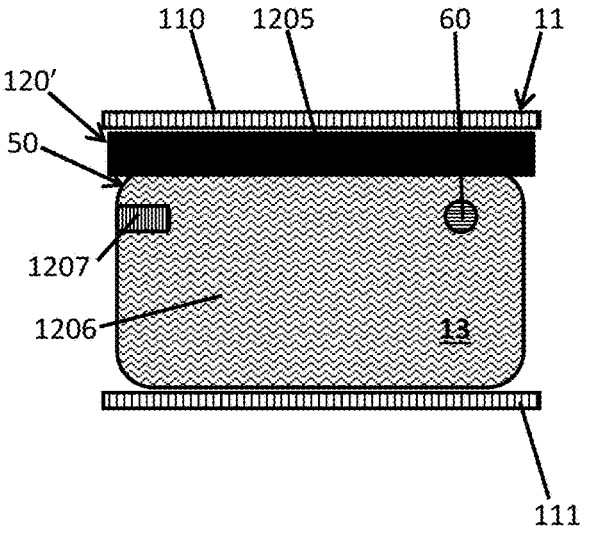
FIG. 11 is a side view of the components of the lift assembly of FIG. 10 in a second configuration in accordance with embodiments.

Turning now to FIGS. 8 and 9 and to FIGS. 10 and 11, a modification of the forklift 12 of FIG. 1 is provided and includes a lift assembly 50 for use with the rack system 10 and the pallet 11 of FIGS. 1-3. The lift assembly 50 includes the tines 120' (modified as described herein) and an engaging element 60. The tines 120' are configured to assume a first configuration during tine insertion and to assume a second configuration in which, following tine insertion, the tines 120' fix an orientation of the pallet 11 relative to the forklift 12. The engaging element 60 is actuatable with the tines 120' initially assuming the first configuration to cause the tines 120' to assume the second configuration.

The tines 120' are insertable into a portion of the interior space 13. This portion of the interior space 13 is defined between the tines 120' and one or more of the top deck 110, the bottom deck 111 and the blocks and/or stringers 112. The tines 120' are configured to assume the first configuration during tine insertion into the portion of the interior space 13. In the second configuration, the tines 120' will have expanded and partially or completely filled the portion of the interior space 13. In so doing, the tines 120' effectively fix relative orientations of the pallet 11 and the forklift 12.

The engaging element 60 may be proximal to or remote from the tines 120' and is actuatable automatically or by an operator. In the former case, the engaging element 60 may include or be provided as a sensor (e.g., an electromagnetic sensor, an optical sensor, a piezoelectric sensor, etc.) which senses the insertion of the tines 120' in the portion of the interior space 13. In the latter case, the engaging element 60 may include or be provided as an actuatable button or switch that is proximate to or remote from the tines 120'. In either case, when the engaging element 60 is actuated with the tines 120' initially assuming the first configuration, the engaging element 60 causes the tines 120' to assume the second configuration.

In accordance with embodiments and, as shown in FIG. 8, the tines 120' may each include a first plate 1201, a second plate 1202, a pivot arm 1203 and a driving element 1204. The pivot arm 1203 is pivotally coupled (by, e.g., hinges or pin connections) at opposite ends thereof to the first plate 1201 and to second plate 1202, respectively. The driving element 1204 is operable by the engaging element 60 to securely drive a pivoting of the pivot arm 1203 relative to the first and second plates 1201 and 1202. The driving element 1204 may include or be provided as an electromagnetic, hydraulic or manual driving element and may be proximate to or remote from the pivot arm 1203. In any case, the driving element 1204 may be further configured to maintain the pivot arm 1203 in the pivoted condition so that, when the tines 120' assume the second configuration and are loaded by the pallet 11 and the rack system 10 (see FIGS. 1 and 3), the tines 120' can securely remain in the second configuration.

While the tines 120' are insertable in the portion of the interior space 13 in various arrangements (e.g., with the first plates 1201 abutting with the top deck 110 and the second plates 1202 abutting with the bottom deck 111 with the tines 120' assuming the second configuration, with the first plates 1201 abutting with the bottom deck 111 and the second plates 1202 abutting with the top deck 110 with the tines 120' assuming the second configuration or with the first plates 1201 abutting with the top deck 110 or the bottom deck 111 and the second plates 1202 abutting with a proximal block and/or stringer 112 with the tines 120' assuming the second configuration), FIG. 8 shows that the tines 120' are inserted such that the first plates 1201 abut with the top deck 110 and the second plates 1202 abut with the bottom deck 111 with the tines 120' assuming the second configuration for illustrative purposes only. Here, the tines 120' can be inserted into the portion of the interior space 13 while assuming the first configuration such that the first plates 1201 abut against a lower surface of the top deck 110 and the pivot arm 1203 is angled such that the second plate 1202 is proximate to the first plate 1201 and displaced from an upper surface of the bottom deck 111.

As shown in FIG. 9, once insertion of the tines 120' is complete and the engaging element 60 is actuated, the driving element 1204 causes the pivot arm 1203 to securely pivot relative to the first and second plates 1201 and 1202. This secure pivoting drives the second plate 1202 downwardly until the second plate 1202 abuts with the upper surface of the bottom deck 111 and maintains the second plate 1202 in that downwardly driven location. The tines 120' thereby assume the second configuration in which the tines 120' effectively and securely fill the gap between the lower surface of the top deck 110 and the upper surface of the bottom deck 111. The tines 120' thus prevent a change in the relative orientations of the pallet 11 and the forklift 12 and secures the pallet 11 against tipping.

In accordance with embodiments and, as shown in FIG. 10, the tines 120' may each include an elongate member 1205, an inflatable bladder 1206 and an inflating element 1207 which is operable by the engaging element 60 to inflate the inflatable bladder 1206. The elongate member 1205 may include or be provided as a fork tine and provides structural rigidity for the inflatable bladder 1206. The inflatable bladder 1206 may be formed of compliant or elastomeric materials that are wear and puncture resistant so that the inflatable bladder 1206, once inflated, can remain inflated. The inflating element 1207 is operable by the engaging element 60 to securely inflate the inflatable bladder 1206. The inflating element 1207 may include or be provided as an electromagnetic, hydraulic or manual inflating element and may be proximate to or remote from the inflatable bladder 1206. In any case, the inflating element 1207 may be further configured to maintain the inflation level of the inflatable bladder 1206 so that, when the tines 120' assume the second configuration and are loaded by the pallet 11 and the rack system 10, the tines 120' can securely remain in the second configuration.

While the tines 120' are insertable in the portion of the interior space 13 in various arrangements (e.g., with the elongate members 1205 abutting with the top deck 110 and the inflatable bladders 1206 abutting with the bottom deck 111 with the tines 120' assuming the second configuration, with the elongate members 1205 abutting with the bottom deck 111 and the inflatable bladders 1206 abutting with the top deck 110 with the tines 120' assuming the second configuration or with the elongate members 1205 abutting with the top deck 110 or the bottom deck 111 and the inflatable bladders 1206 abutting with a proximal block and/or stringer 112 with the tines 120' assuming the second configuration), FIG. 10 shows that the tines 120' are inserted such that the elongate members 1205 abut with the top deck 110 and the inflatable bladders 1206 abut with the bottom deck 111 with the tines 120' assuming the second configuration. Here, the filling element 30 can be inserted into the portion of the interior space 13 while assuming the first configuration such that the elongate members 1205 extend through a portion of the pallet 11 with the inflatable bladders 1206 in an uninflated condition.

As shown in FIG. 11, once insertion of the tines 120' is complete and the engaging element 60 is actuated, the inflating element 1207 causes the inflatable bladders 1206 to securely inflate such that the inflatable bladders 1206 abut with and pressurize the elongate members 1205 and the upper surface of the bottom deck 111. The tines 120' thereby assume the second configuration in which the tines 120' effectively and securely fill the gap between the lower surface of the top deck 110 and the upper surface of the bottom deck 111. The tines 120' thus prevent a change in the relative orientations of the pallet 11 and the forklift 12 and secures the pallet 11 against tipping.

Figure 12:
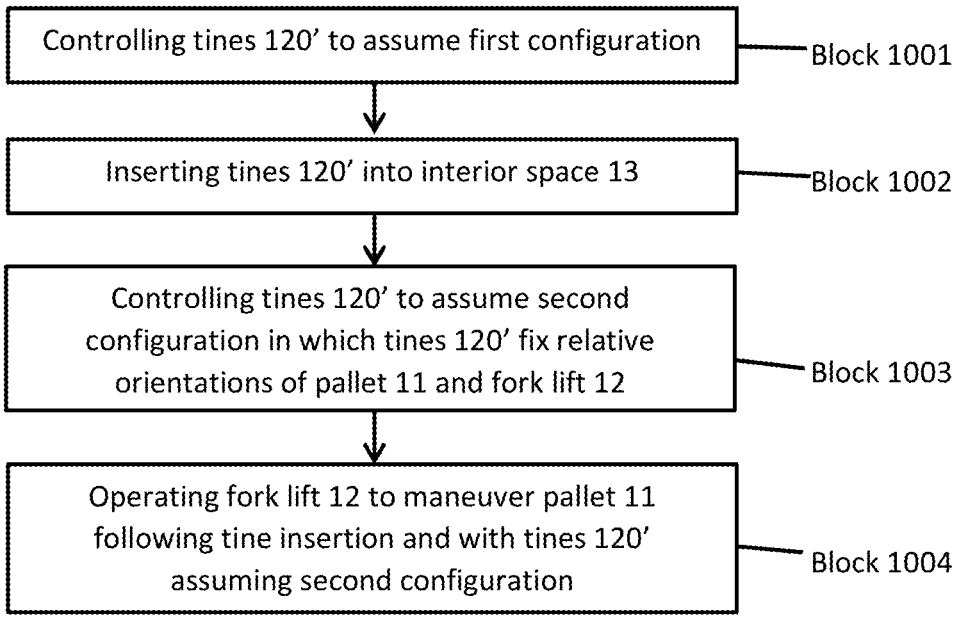
FIG. 12 is a flow diagram illustrating a method of operating a pallet gap filler in accordance with embodiments.

With reference to FIG. 12, a method of operating the lift assembly 50 of FIGS. 8-11 for the pallet 11 is provided. As shown in FIG. 12, the method includes controlling the tines 120' to assume the first configuration (block 1001), inserting the tines 120' into the interior space 13 (block 1002) and controlling the tines 120' to assume the second configuration in which the tines 120' fix the relative orientations of the pallet 11 and the forklift 12 by actuating a proximal or remote engaging element (block 1003). The method may further include operating the forklift 12 to maneuver the pallet 11 following tine insertion and with the tines 120' assuming the second configuration (block 1004).

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks and/or stringers in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks and/or stringers. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks and/or stringers.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks and/or stringers.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks and/or stringers may occur out of the order noted in the Figures. For example, two blocks and/or stringers shown in succession may, in fact, be executed substantially concurrently, or the blocks and/or stringers may sometimes be executed in the reverse order, depending upon the functionality involved. It will also be noted that each block of the block diagrams and/or flowchart illustration, and combinations of blocks and/or stringers in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The descriptions of the various embodiments herein have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A pallet gap filler for a pallet and a lift and comprising:

a filling element insertable into space defined between tines of the lift and decks and blocks and/or stringers of the pallet, the filling element being configured to assume:

a first configuration during insertion, and a second configuration in which, following insertion, the filling element fixes relative orientations of the pallet and the lift; and an engaging element actuatable to cause the filling element to assume the second configuration, wherein the filling element comprises an inflatable bladder and an inflating element operable by the engaging element to securely inflate the inflatable bladder.

2. The pallet gap filler according to claim 1, wherein the filling element comprises:

first and second plates;

a pivot arm pivotally coupled at opposite ends thereof to the first and second plates, respectively; and a driving element operable by the engaging element to securely drive a pivoting of the pivot arm relative to the first and second plates.

3. The pallet gap filler according to claim 2, wherein the filling element is insertable between the tines and a top or a bottom deck of the pallet.

4. The pallet gap filler according to claim 2, wherein the filling element is insertable between the tines and the blocks and/or stringers of the pallet.

5. The pallet gap filler according to claim 1, wherein the filling element is insertable between the tines and a top or a bottom deck of the pallet.

6. The pallet gap filler according to claim 1, wherein the filling element is insertable between the tines and the blocks and/or stringers of the pallet.

7. The pallet gap filler according to claim 1, wherein the engaging element comprises an actuator by which the engaging element is actuated to cause the filling element to assume the second configuration.

8. The pallet gap filler according to claim 1, wherein the engaging element is proximal to or remote from the filling element.

9. A lift assembly, comprising:

tines insertable into a pallet; and a lift coupled to the tines and operable to control the tines to maneuver the pallet following tine insertion, the tines being configured to assume:

a first configuration during insertion, and a second configuration in which, following insertion, the tines fix an orientation of the pallet relative to the lift, the lift assembly further comprising an engaging element actuatable to cause the tines to assume the second configuration, wherein:

the tines each comprise a first plate, a second plate, a pivot arm pivotally coupled at opposite ends thereof to the first and second plates, respectively, and a driving element operable by the engaging element to securely drive a pivoting of the pivot arm relative to the first and second plates, and the first and second plates are abuttable with the pallet with the tines assuming the second configuration.

10. The lift assembly according to claim 9, wherein the tines each comprise:

first and second plates;

a pivot arm pivotally coupled at opposite ends thereof to the first and second plates, respectively; and a driving element operable by the engaging element to securely drive a pivoting of the pivot arm relative to the first and second plates.

11. A lift assembly, comprising:

tines insertable into a pallet; and a lift coupled to the tines and operable to control the tines to maneuver the pallet following insertion, the tines being configured to assume:

a first configuration during insertion, and a second configuration in which, following insertion, the tines fix an orientation of the pallet relative to the lift, the lift assembly further comprising an engaging element actuatable with the tines initially assuming the first configuration to cause the tines to assume the second configuration, wherein the tines each comprise:

an elongate member;

an inflatable bladder anchored to the elongate member; and an inflating element operable by the engaging element to securely inflate the inflatable bladder.

12. The lift assembly according to claim 11, wherein the elongate member and the inflatable bladder are abuttable with the pallet with the tines assuming the second configuration.

13. The lift assembly according to claim 11, wherein the lift comprises a forklift and the engaging element comprises an actuator aboard the forklift by which the engaging element is actuated to cause the tines to assume the second configuration.

14. A method of operating a lift assembly for a pallet comprising top and bottom decks and blocks and/or stringers separating the top and bottom decks, the method comprising:

controlling tines, which are coupled to a lift and insertable into a space between the top and bottom decks and the blocks and/or stringers, to assume a first configuration;

inserting the tines into the space; and controlling the tines to assume a second configuration in which the tines fix an orientation of the pallet relative to the lift.

15. The method according to claim 14, wherein the controlling of the tines to assume the second configuration comprises actuating a proximal or remote engaging element.

16. The method according to claim 14, further comprising operating the lift to maneuver the pallet following tine insertion and with the tines assuming the second configuration.

* * * * *